United States Patent [19]

Stocking et al.

[11] 4,378,679

[45] Apr. 5, 1983

[54] AIR CONDITIONING APPARATUS

[75] Inventors: George E. Stocking; Bruce L. Ruark, both of Louisville, Ky.

[73] Assignee: General Electric Company, Louisville, Ky.

[21] Appl. No.: 300,351

[22] Filed: Sep. 8, 1981

[51] Int. Cl.[3] ..... F25B 47/00

[52] U.S. Cl. ..... 62/280; 62/305; 62/324.1

[58] Field of Search ..... 62/279, 280, 305, 324.1, 62/91, 150, 324.6

[56] References Cited

U.S. PATENT DOCUMENTS

| | | | |
|---|---|---|---|
| 2,777,303 | 1/1957 | Slattery | 62/140 |
| 2,797,560 | 7/1957 | Kooiker et al. | 62/140 |
| 2,911,797 | 11/1969 | Stocking | 62/176 |
| 2,982,110 | 5/1961 | Kramer | 62/91 |
| 3,152,454 | 10/1964 | Eberhart | 62/150 |
| 4,136,529 | 1/1979 | McCarty | 62/280 |

*Primary Examiner*—Lloyd L. King

*Attorney, Agent, or Firm*—Frank P. Giacalone; Radford M. Reams

[57] ABSTRACT

In a self-contained air conditioner unit of the reversible refrigeration system type having cooling and heating cycles, a no-drain heat pump is provided wherein in the heating cycle, water collected on the outdoor heat exchanger operating as the system evaporator is transferred to the indoor section. The condensate is atomized and directed into the indoor air flow and against the relatively warm indoor heat exchanger operating as the condenser to humidify the air.

6 Claims, 9 Drawing Figures

AIR CONDITIONING APPARATUS

CROSS REFERENCE TO RELATED APPLICATIONS

This application is related to concurrently filed applications Ser. Nos. 299,913, filed in the name of George E. Stocking, and 300,081 filed jointly in the names of George E. Stocking, Joseph R. Noland, and Donald L. Sidebottom, each assigned to General Electric Company, the assignee of the present invention.

BACKGROUND OF THE INVENTION

Conditioning the air within an enclosure has been accomplished by self-contained unit employing a refrigeration heat pump with the unit generally located within an opening in the enclosure. In order to both heat and cool the air within the enclosure, the reversible type refrigeration apparatus has been used including two heat exchangers, one located so as to allow recirculation of the enclosure air therethrough and the other located so as to allow the recirculation of outdoor air therethrough. The heat exchangers operate interchangeably as condensers and evaporators to both heat and cool the enclosure. Control means are provided by which reversal of the refrigeration cycle can be obtained.

The units are usually provided with sump areas located in the outdoor section of the unit at a level below the heat exchangers. Conduit means are provided for directing condensate collected by the indoor heat exchanger when it functions as an evaporator to the sump area, while condensate collected from the outdoor coil when it functions as the evaporator is also directed into the sump area. Condensate removal means operable in the cooling cycle directs the condensate from the sump into the outdoor coil functioning as the condenser to cool it and dispose of the condensate by evaporation. The condensate collected in the sump during the heating cycle when the outdoor heat exchanger functions as the evaporator cannot be disposed of in this manner and may, in fact, freeze since the unit may at times operate at below freezing temperatures. Water frozen in the sump area may in some instances result in locked fans which can result in blown fuses, burned out motor and other damages.

Some prior art attempts have provided drains in the sump area, such as disclosed in U.S. Pat. No. 2,777,303-Slattery, assigned to the General Electric Company, the assignee of the present invention. The patent teaches the use of a thermally responsive element that cooperatively opens the drain when the outside temperature falls below a predetermined temperature to drain the sum of any condensate that may have collected.

U.S. Pat. No. 2,982,110-Kramer appears to disclose an apparatus that selectively conducts condensate formed at the outdoor heat exchanger to the vicinity of the indoor heat exchanger during the heating cycle in accordance with predetermined humidity conditions in the vicinity of the latter heat exchanger, and treats the circulating air being heated by entraining the condensate therein.

U.S. Pat. No. 4,136,529-McCarty, assigned to the General Electric Company, the assignee of the present invention, discloses an apparatus wherein the condensate collected in the outdoor sump in the heating cycle is disposed of by directing it to the indoor section where it is entrapped in the recirculating enclosure air and passed through the relatively warm indoor heat exchanger to humidify the air.

SUMMARY OF THE INVENTION

The present invention relates to a self-contained air conditioning unit for heating and cooling having condensate disposal means and includes a casing mounted in an aperture in the wall of an enclosure to be conditioned. Arranged in the casing is a chasis including a base portion and a barrier dividing the chassis into an indoor and an outdoor compartment. Mounted in the inner compartment is an indoor heat exchanger and a fan for recirculating enclosure air through the indoor compartment. Mounted in the outdoor compartment is an outdoor heat exchanger, a fan for circulating air through the outer compartment, the system compressor, and a reversing valve for selectively connecting the compressor to the heat exchangers whereby the outdoor heat exchanger functions as an evaporator during the heating cycle and the indoor heat exchanger functions as the evaporator during the cooling cycle.

In the heating cycle, water condensed on the outdoor heat exchanger functioning as an evaporator during heating collects in a sump in the outdoor compartment. The water is lifted out of the sump and directed into the air flow circulating through the indoor section where it atomizes and passed through the relatively warm indoor heat exchanger functioning as a condenser to humidify the air.

A motor driven disc is employed to lift the condensate from the sump area and for directing it into the indoor air stream. The motor is de-energized together with the outdoor fan, and prevented from operating when the unit is in the cooling unit.

DESCRIPTION OF THE PREFERRED EMBODIMENT

Figure 1:
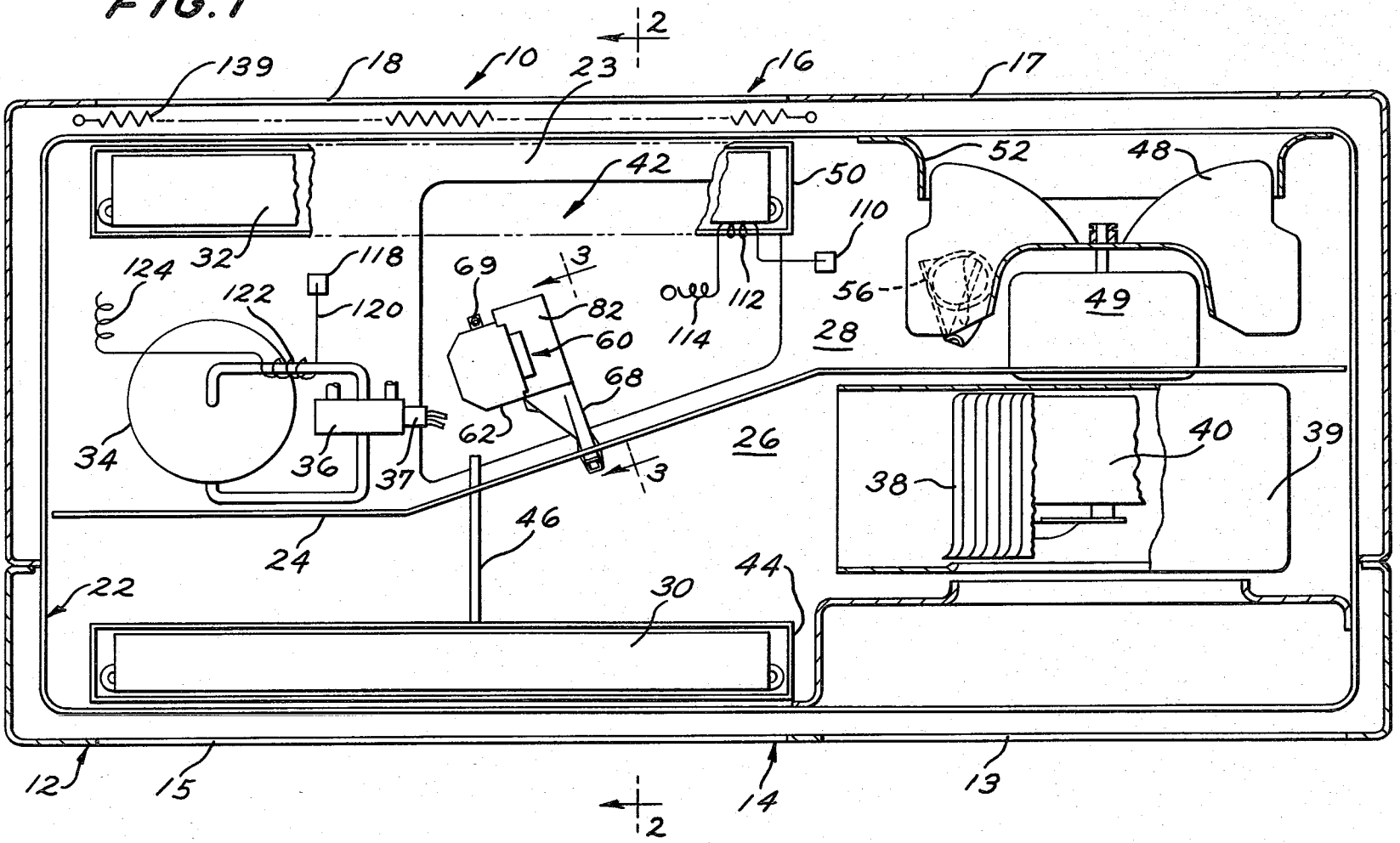
FIG. 1 is a plan view partially in section of an air conditioning unit incorporating the condensate disposal system of the present invention.

Referring now to the drawings and initially to FIG. 1 thereof, there is illustrated an air conditioner unit 10 which is arranged to be positioned within an opening of an enclosure. The unit includes a casing or outer sleeve 12 having a front opening 14 including an inlet 13 and an outlet 15 disposed in the enclosure to be conditioned, and a rear opening 16 including an inlet 17 and an outlet 18 exposed to the outdoor ambient. A chassis unit 22 including the refrigeration system and components of the unit is arranged in the sleeve 12. The chassis 22 includes a base 23 that is divided by a partition or barrier 24 into an indoor compartment 26 and an outdoor compartment 28 in which are mounted respectively an indoor heat exchanger 30 and an outdoor heat exchanger 32. The heat exchangers 30 and 32 are connected in refrigerant flow relationship with a compressor 34 also positioned in the outer compartment 28.

In the illustrated embodiment of the invention, the refrigeration system is a heat pump of the reversible refrigerant flow type, and is provided with a reversing valve 36. The valve 36 may be selectively operated by a solenoid 37 to reverse the flow of refrigerant to the heat exchanger units 30 and 32 so that they function interchangeably as the evaporator or condenser to heat or cool the respective air streams circulated over the heat exchangers.

Figure 2:
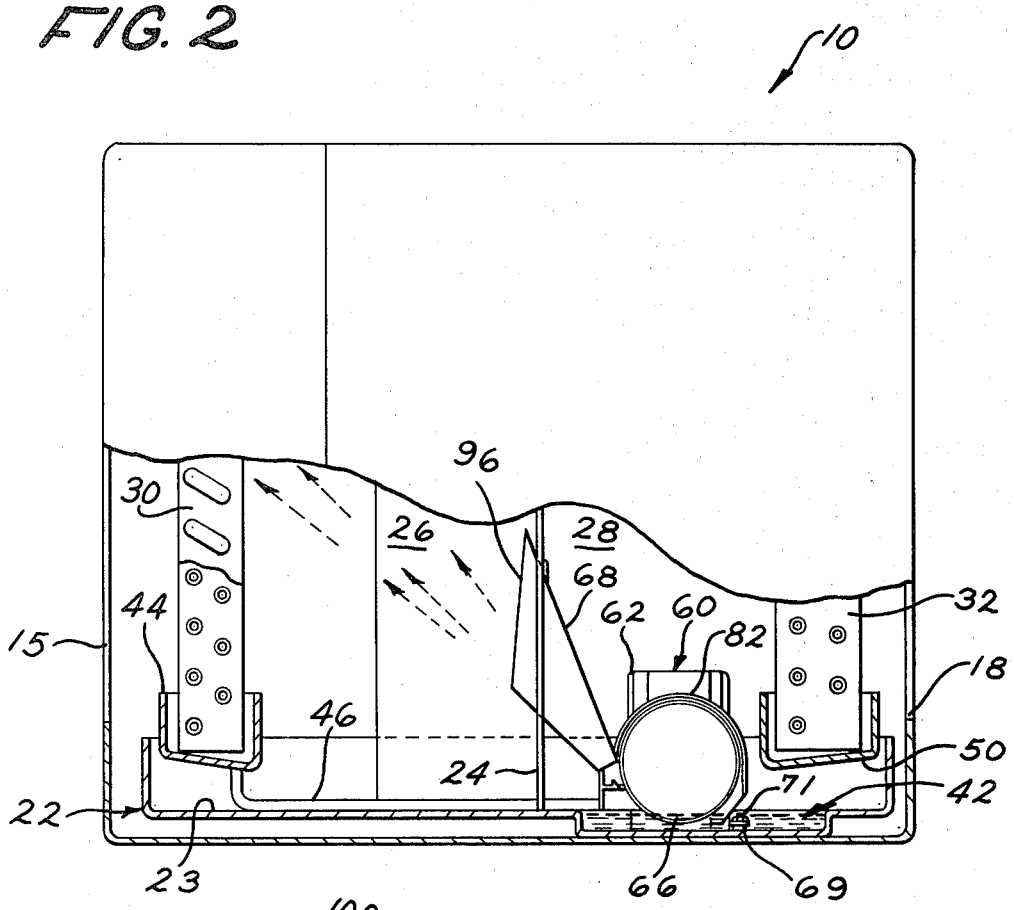
FIG. 2 is a partial side elevational view taken along line 2—2 of FIG. 1.

When the conditioner is in operation, air is drawn from within the enclosure through inlet 13 and recirculated by an air moving means or blower wheel 38 arranged in a scroll 39. The room air is directed through the indoor compartment 26, passed through the heat exchanger 30 the through outlet 15. The blower 38 is driven by a motor 40 mounted on the inside wall of the barrier 24. During operation of the unit in the cooling cycle, the heat exchanger 30 is functioning as the system evaporator and moisture from the air stream being circulated over the heat exchanger 30 is condensed onto its coil surfaces. Means are provided for collecting this condensate water and delivering it to a water receptacle or sump area 42 formed in the base 23 of chassis 22 in the outer compartment area 28. More specifically, these means include a suitable drip tray 44 as seen in FIGS. 1 and 2. Water collected in the tray 44 is delivered to the sump area 42 through a conduit 46 extending from the tray 44 to an open end communicating with the sump area 42 in the outdoor compartment. With the air conditioning unit operating in the cooling cycle, the outdoor heat exchanger 32 functions as the system condenser and is cooled by the outdoor air being circulated thereover by a fan 48 driven by the motor 49 mounted on the outside wall of the barrier 24.

When the unit is operating on the heating cycle, the reversing valve 36 is positioned to reverse the flow of refrigerant to the heat exchangers 30 and 32, thereupon utilizing the indoor heat exchanger 30 as the system condenser. The outdoor heat exchanger 32, now functioning as the system evaporator, condenses moisture out of the outside air. Condensate water from heat exchanger 32 accumulates in a drip tray 50 and is thereby delivered to the condensate collection sump 42. As will be explained in detail hereinafter, it is this water collected in the sump area 42 from the outdoor heat exchanger that is transferred to the indoor compartment when the unit is operating in the heating cycle and therein added to the recirculating indoor air.

It is to be noted that sump area 42 may take on any desirable form and is, of course, not limited to the arrangement wherein the water collecting area forms the entire or substantially the entire bottom wall of base 23 in the outdoor side 28 of chassis 22. In the cooling cycle, water collected in the sump 42 from the indoor heat exchanger 30 is disposed in the following manner. Air moving means 48 for circulating air through the outdoor compartment 28 is disposed so that it circulates at least a portion of the air stream in a direction substantially parallel with and over the surface of the water in the sump 42. More specifically, the air that fan 48 draws inwardly through the inlet opening 17 and the orifice opening 52 impinges on the barrier 24 and is diverted radially by the fan 48 and barrier 24 into the remaining portions of the outdoor compartment 28.

In the embodiment shown, the fan 48 is a mixed-flow fan in which the air is propelled rearwardly by the forward portions of the fan blades and turned within the fan to be propelled in a direction normal to the axis of the fan. The mixed-flow fan 48 circulates a stream of air along the surface of the water in the sump 42 and this air stream, as will hereinafter be described, aids in the entrainment of water droplets from the sump 42 into the air stream flowing through the outdoor compartment. The air stream flows through the remaining portions of the outdoor compartment 28, over the heat exchanger 32, and then discharged to the outdoors through an outlet opening 18. It should be noted that while a mixed-flow fan creates a great deal of radial air flow, this is also true of the normal axial flow fan and such a fan could be used as long as a portion of the air stream discharging therefrom passes over the surface of the water in the sump 42.

In order to aid in disposing of condensate water collected in the sump 42, an air vortex generator 56 of the type fully explained in U.S. Pat. No. 3,079,767, assigned to the General Electric Company, the assignee of the present invention, may be used. The vortex generator 56 is designed to receive or trap a portion of the air stream circulating through the outer compartment and to impart a swirling motion, as well as a thrust, to this swirling air mass in an angular direction with respect to the original direction of air flow, thereby creating a relatively stable air vortex discharging from the generator.

By the present invention, means operable in the heating cycle are provided for transferring the condensate water collected in the sump 42 during the heating cycle to the indoor compartment where the moisture may be added to the indoor air being recirculated by the blower 38.

In carrying out the disposal of condensate generated when the unit is operating in the heating cycle while at the same time humidifying the indoor air, means are provided for transferring the condensate collected in the outdoor compartment sump area 42 into the air stream being recirculated by blower 38 through the enclosure. The means for transferring the condensate into the indoor air stream includes a slinger mechanism 60 arranged in the outdoor chamber 28. The slinger mechanism is positioned in the sump area 42 generally between the partition 24 and the heat exchanger 32, and in alignment with the indoor heat exchanger 30. As shown in FIG. 2, the slinger mechanism 60 includes a housing 62, a motor driven slinger disc 66 and a condensate passageway 68 through which the condensate is transferred to the indoor compartment 26.

Figure 5:
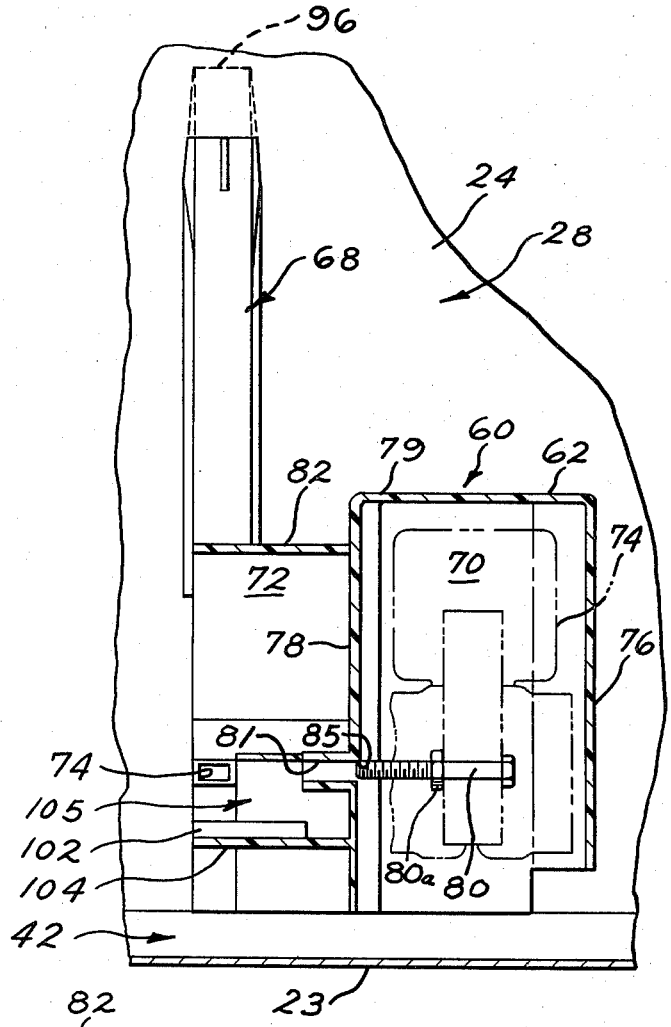
FIG. 5 is a side elevational view in section taken along line 5—5 of FIG. 3 with the motor partially assembled.
Figure 6:
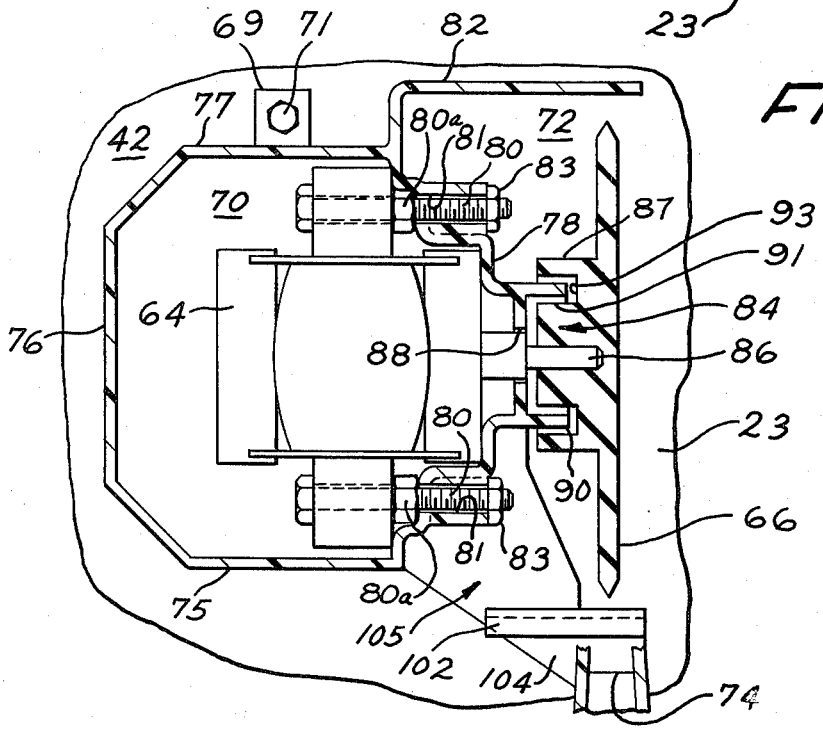
FIG. 6 is a plan view in section taken along line 6—6 of FIG. 3.

Referring now to FIGS. 5–6, the housing 62 is formed to provide an interior motor compartment portion 70 and a lifting area 72 in which the slinger disc 66 is arranged. The inlet 74 (FIGS. 3 and 7) of condensate transfer passageway 68 through which condensate is directed to the indoor compartment 26 communicates with the lifting area 72. The compartment 70 has a generally square cross section as seen in FIG. 6 and includes impervious side walls 75, 76, 77, 78 and a top wall 79 leaving an open bottom through which the motor 64 is inserted into compartment 70 as will be explained below. The lower-most portions of the housing 62 side walls are dimensioned to be arranged in the sump 42. The passageway 68 in the present instance is formed as an integral part of the slinger mechanism 60 and extends from the lifting area 72. The slinger mechanism is arranged in the outdoor chamber 28 as shown in the drawings with the outwardly extending end 96 of passageway 68 positioned in an opening 97 formed in the barrier 24. With the mechanism 60 so positioned relative to the sump 42 and barrier 24, it may be secured to the unit chassis 22 in any suitable manner as by a bracket 69 and fastening means 71.

Figure 8:
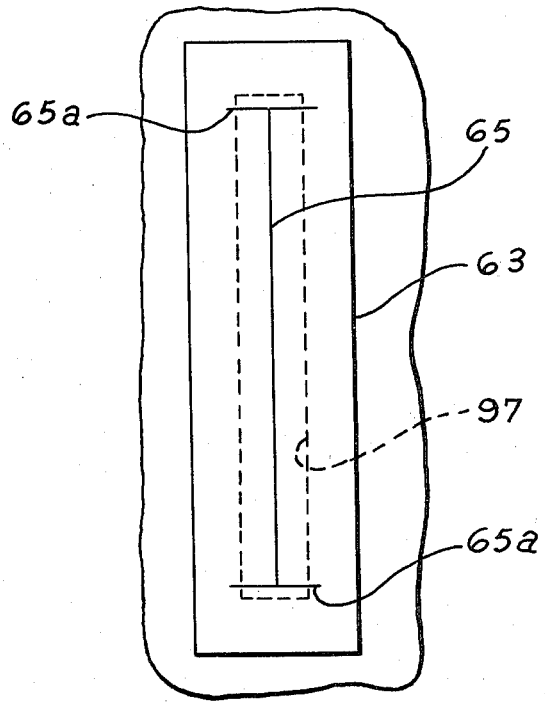
FIG. 8 is an elevational view taken along line 8—8 of FIG. 3 showing the sealing arrangement employed on the unit barrier with the condensate disposal system removed.

The assembling of the mechanism 60 to the air conditioning unit includes a self-sealing arrangement wherein a gasket 63 (FIG. 8) having an adhesive backing is applied to the barrier 24 in a manner that covers the opening 97. The gasket provides a substantially air tight seal between the indoor and outdoor compartments. The gasket has formed therein a slot 65 which is centered relative to the opening 97. The slot 65 has a vertical height that is slightly less than that of the end 96 so that a tight fit is obtained between the yieldable gasket and the end 96 of passageway 68. Since the length of slot 65 is less than that of end 96, assembling the mechanism 60 to the chassis requires that the upper portion of end 96 of passageway 68 be initially inserted in slot 65 as shown in dotted lines in FIG. 3. The slinger mechanism is located in this position by the projection 67 engaging the upper portion of opening 97 as shown. The mechanism is then rotated from this position with projection 67 as the pivot until the lower end portion of end 96 is positioned in the slot 65 and the housing 62 lowered until it is in engagement with the base 23 in sump 42. Horizontal slits 65*a* are formed at each vertical end of slot 65 to provide for the thickness of passageway 68. As the end 96 of passageway 68 is positioned in the slot 65 and, more particularly, in indoor compartment 26 the slits 65*a* allow deflection of the gasket as shown in FIG. 4. This deflection of gasket 63 allows an air tight seal to be maintained between the end portion 96 of passageway 68 and the gasket. The insertion of end 96 through the slot 65 is facilitated by the taper formed in the end 96.

The motor 64 is mounted in the compartment 70 of the housing and secured to the wall 78 by suitable screws or bolts 80 that extend from the motor. The bolts 80 are secured to the motor 64 by nuts 80*a*. The compartment 70 is dimensioned so that the motor 64 and its extending bolts 80 can be inserted into the compartment through the open bottom. With the motor 64 so positioned in compartment 70, the bolts 80 are then aligned with and inserted into appropriately dimensioned openings 86 in wall 78 and secured thereto by nuts 83. Means are provided to insure proper alignment of the bolts 80 with their respective openings 81 when the motor 64 is inserted into the compartment 70 through the open bottom. The inner wall portion of wall 78 immediately above the openings 81 is provided with a projection 85 which in effect is an axial extension of the upper wall portion of the opening 81. In inserting motor 64 into compartment 70, the bolts 80 are maintained against the inner surface of wall 78 until the bolts come into contact with projection 85. The engagement of bolts 80 with projection 85, as shown in FIG. 5 places the bolts in alignment with the openings 81. With the bolts so aligned with openings 81, the motor is then moved axially into openings 81 so that the bolts extend through the wall 78 where the nuts may be employed to secure the motor to the housing 62. To further facilitate the alignment of the motor bolts 85 with their respective openings 81, the portion of the housing wall below the openings 81 in compartment 70 may further be provided with a groove that would terminate at the openings 81 and the projection 85 would, in fact, be the upper end of the groove. In this instance, the distal ends of the bolts 80 would be placed in the groove and ride therein until they align with the openings 81.

The positioning of the motor 64 within the substantially enclosed compartment 70 provides adequate protection for the motor from the condensate and moisture in the surrounding atmosphere to the extent that a standard open type motor may be employed rather than a more expensive enclosed water resistant type. In order to provide an additional margin of safety regarding moisture protection of the motor, it should be noted that in the presently employed motor, the windings are near the top of the housing when the motor is mounted in the housing. This places the electrical components of the motor near the top of the housing and above possible flooding by extreme conditions caused by wind, rain or reasonable tilt of the air conditioning unit.

The motor 64 includes a substantially horizontally disposed drive shaft 86 (FIG. 6) that extends through an aperture 88 in the wall 78 of housing 62 so as to be positioned in the area 72. The area 72 is generally defined by the wall 78 of housing 62, and an arcuate cover or hood portion 82 that extends from housing 62. The area 72 and hood 82 serve to prevent water spinning off disc 66 that does not enter inlet 74 from spraying the outdoor compartment, and more particularly the outdoor heat exchanger, with condensate during the heating cycle which under some ambient conditions may freeze.

To further insure the integrity of compartment 70, relative to the surrounding water and moisture, means are provided that effectively prevent moisture from entering through opening 88. To this end, the aperture 88 in the wall 78 is centered with respect to a horizontally projecting collar 90. The disc 66 includes a hub 84 that has formed therein an annular groove 93. The annular groove 93 is dimensioned to fit over the collar 90. This arrangement leaves an outer portion 87 of hub 84 positioned circumferentially outside of the collar 90 and a central portion 91 positioned within the collar 90 when the disc 66 is, as shown in FIG. 6, rotatably mounted on the drive shaft 86. This arrangement provides a labyrinth that effectively prevents water from reaching the area of the aperture 88 and possibly invading the compartment 70 and contacting the motor 64.

Figure 7:
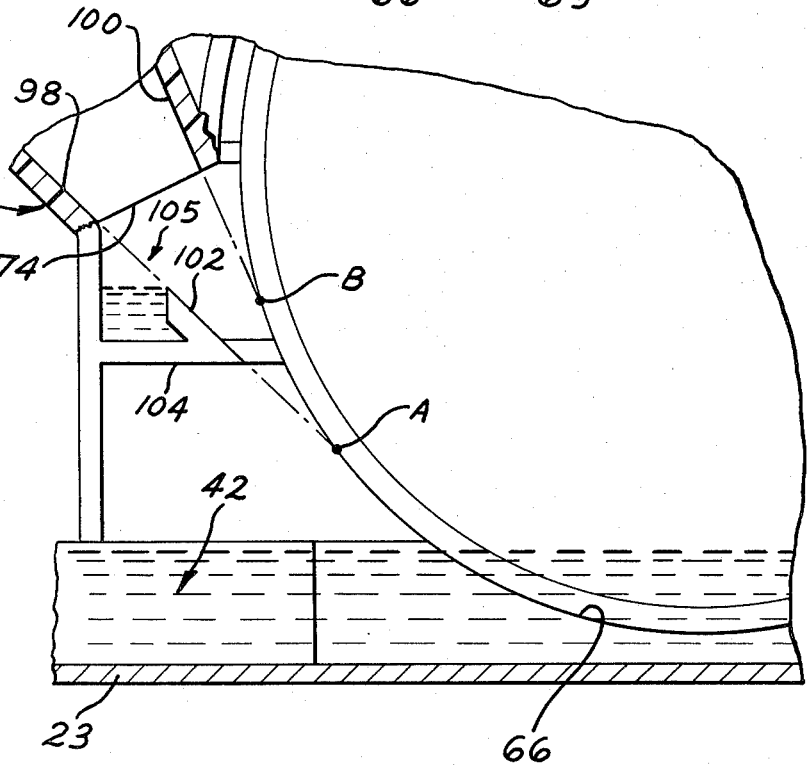
FIG. 7 is an enlarged fragmented elevational view showing details of the mechanism.
Figure 3:
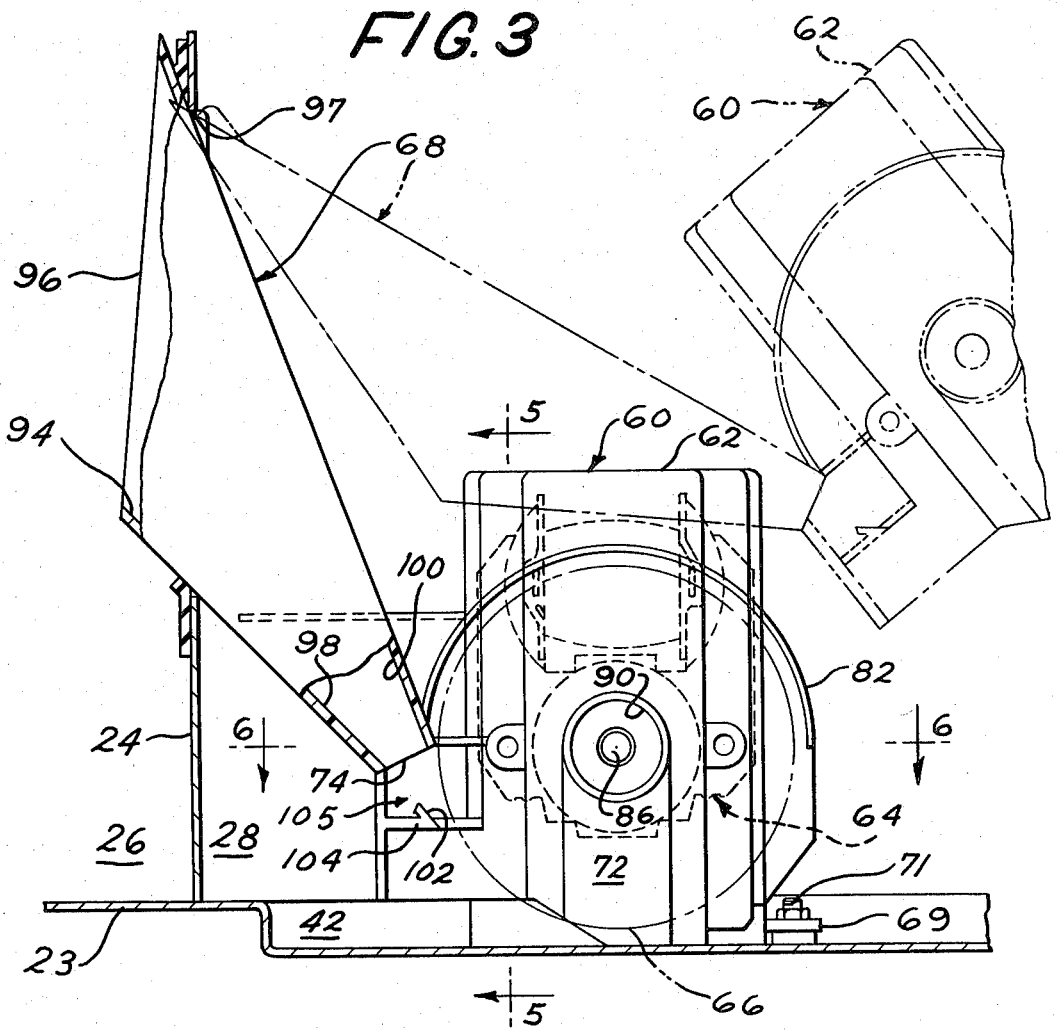
FIG. 3 is a side elevational view of the condensate slinger mechanism taken along line 3—3 of FIG. 1.
Figure 4:
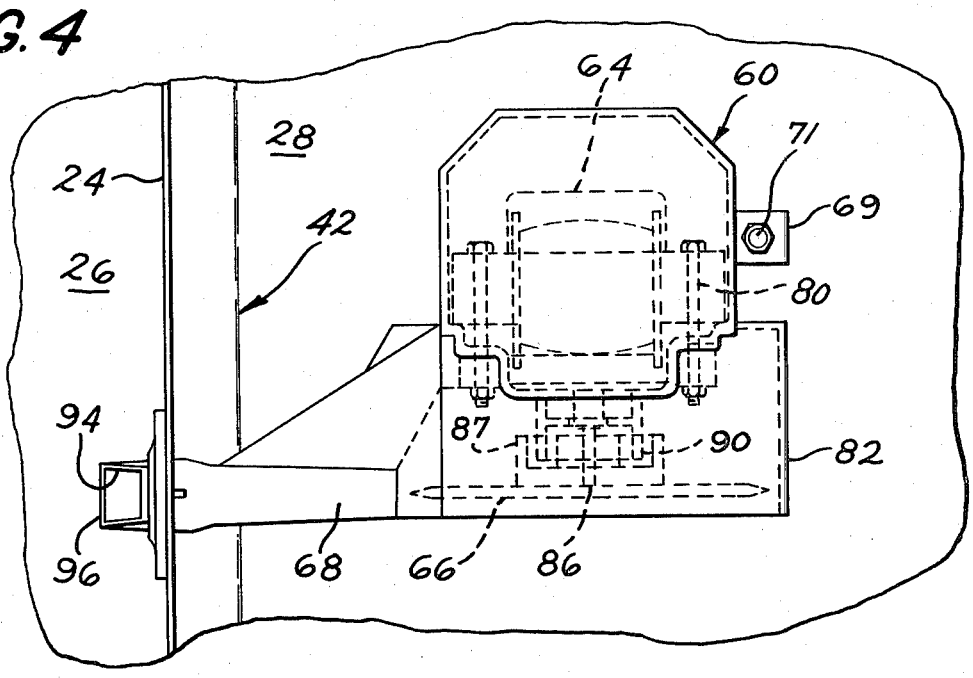
FIG. 4 is a plan view of the mechanism shown in FIG. 3.

As shown in FIGS. 2, 3 and 7, the lower portion of disc 66 is positioned in the sump area 42 and will be submerged in condensate when it is present in the sump. The passageway 68 in the present embodiment is formed as an integral part of slinger mechanism 60 and extends from area 72. The passageway 68 includes the inlet 74 communicating with area 72 and an outlet 94 at its other end 96. As mentioned above, the end 96 of passageway 68 is arranged in opening 97 in the barrier 24 so that the outlet 94 is in fact positioned in the indoor compartment 26. Referring now to FIGS. 3 and 7, it will be seen that the bottom wall 98 of passageway 68 is in a plane that generates generally radially from a point A tangent with the circumferential edge of the disc 66. The top or upper wall 100 of passageway 68 is in a plane that generates radially from a second point B tangent with the circumferential edge of the disc 66. In effect, the passageway 68 fans out or diverges from the relatively small inlet 74 to the substantially larger outlet 94. This fanning out of passageway 68 insures that the condensate entering the relatively small inlet 74 will exit the outlet 94 substantially unobstructed. This arrangement of diverging walls 98, 100 permits a relatively small inlet opening 74 which results in a minimum amount of air transfer between the indoor and outdoor compartment.

In operation, during the heating cycle, the slinger disc 66 driven by motor 64 picks up the condensate water from the sump 42 and spins out, or throws a relatively thin wall of fine mist tangentially off the circumferentially disposed edge of the disc through the inlet 74 in a pattern extending substantially between the lower and upper walls 98 and 100 respectively and into the indoor compartment 26. To insure that water thrown out tangentially by the disc 66 is in the form of fine or thin wall, the circumferentially disposed edge thereof is tapered as shown in FIG. 6 to a substantially knife edge. A portion of this thin wall of mist emerging from outlet 94 is drawn into the air stream circulating through the indoor compartment 26 with the remaining portion of condensate being thrown directly into the surface area of the relatively warm indoor heat exchanger 30. Accordingly, the condensate generated during operation of the unit in the heating cycle is disposed of without employing a drain while providing humidification of the enclosure air.

By positioning the walls 98 and 100 so that they are each in a plane generally tangent with a point on the outer peripheral edge of the disc 66, water spinning off the disc will not impinge on the surface of walls 98 and 100. This arrangement is critical since water impinging on the walls and particularly the lower wall 98 will tend to accumulate and run down the wall. This accumulation of water running down the wall 98 will be met at the inlet 74 with the mist spinning off disc 66. This interference between water coming off the disc 66 and that accumulating on wall 98 will cause a restriction to the passage of condensate or in the extreme situation, a blockage at the relatively small inlet that would prevent transfer of condensate through passageway 68. The length of wall 98 and its angle is selected so that any portion of water lifted by disc 66 from sump 42 that does not have sufficient velocity to reach the surface of heat exchanger 30 is returned to the sump 42.

Means are provided to prevent blockage of the inlet 74 by water accumulating on the surface wall 98. To this end, a short wall 102, as shown in FIGS. 3, 5 and 7, is provided downstream of inlet 74 to function in the following manner. The surface of wall 102 is in substantially the same plane as wall 98 and is arranged on a shelf 104 extending from the inlet 74. The wall 102 is spaced from inlet 74 to provide a gap or space 105 between the upper edge of wall 102 and the lowermost edge of wall 98 at the inlet 74. This arrangement of the wall 102 relative to wall 98 providing the gap 105 causes water that may accumulate on wall 98 to run out of inlet 74 and into the gap 105 and out of the path of water spinning off disc 66. This water will land on shelf 104 and run off back into sump area 42. Water that impinges on the short wall 102 will either be driven into the gap 105 and run off the shelf 104 or will run back down the wall 102 to drip off the lowermost edge of wall 102 and into the sump area. Under normal air conditioning operating conditions, that is, with the outdoor fan 48 functioning in the manner described above, water coming off the vortex 56 and sump area 42 may be forced against the housing 62 and further may become trapped in the area of opening 74 and shelf 104.

To insure that water, if entrapped in the shelf area runs back into the sump area and does not impede or interfere with the wall of water coming off disc 66, an opening 105 is provided in the housing 62. As air from fan 48 is forced into the housing, it will force any excess water that may be present in the area of inlet 74 through opening 105 and back into the sump area 42.

In operation of the condensate disposal system, the heat of the indoor heat exchanger 30 functioning as the system condenser is effective in evaporating the moisture as it contacts and passes through the heat exchanger whereupon the vapor and any remaining moisture flows with the recirculating air into the enclosure being conditioned to provide humidification of the enclosure air. This entrainment of moisture continues so long as the level of condensate water in sump 42 is at or above the lower peripheral edge of disc 66.

With the condensate collecting sump arranged outdoors, it is subjected to the outdoor ambient which may be below freezing during certain operating times when the unit is in the heating cycle. Accordingly, control means are provided to prevent the operation of the motor 64 in the event that condensate, when present in the sump, freezes around the disc 66 that may cause damage to the slinger mechanism and to save energy. Further, control means are provided to prevent operation of the slinger mechanism when the unit is in the cooling cycle so that condensate will not be directed at the indoor heat exchanger when it is functioning as the system evaporator.

To this end, means are incorporated to the control system as shown in FIG. 7. The control system employed in carrying out the present invention is similar to that fully disclosed in U.S. Pat. No. 4,102,391-Noland assigned to the General Electric Company, the assignee of the present invention, and accordingly will not be explaind in full detail.

Figure 9:
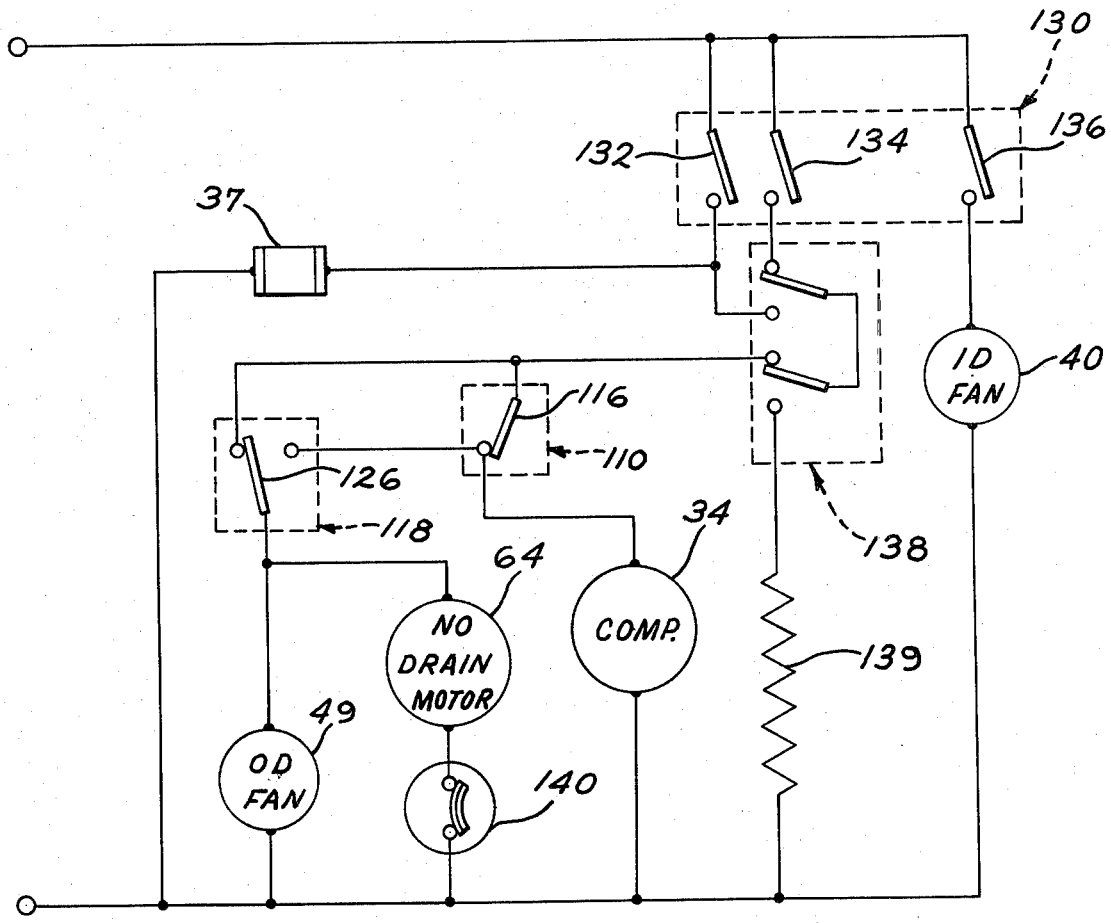
FIG. 9 is a wiring schematic showing a control system for the air conditioning unit.

Referring now to FIGS. 1 and 9, the control circuit includes the customary mode selection switch 130 having a heating cycle switch 132, a cooling cycle switch 134 and an indoor fan speed selector switch 136. A two-stage thermostat 138 is employed to maintain the enclosure temperature at a preselected level in both heating and cooling. When the system functions through the second stage of thermostat 138, a circuit is completed through an auxiliary heater 139 that provides heat when the compressor is de-energized due to a frost condition. The switch-over or reversing valve 36 is controlled by the relay 37 energized when the heating switch 132 is closed. The control system further includes a first thermostat 110 including a sensing element 111 having one portion 112 exposed to the surface temperature of the outdoor heat exchanger 32 and another portion 114 exposed to the sump drain area 42. The first thermostat 110 includes a switch 116 operable by the sensing element 111 that is effective in de-energizing the compressor 34 when either of the portions of element 111 sense a preselected frosting temperature.

A second thermostat 118 includes a sensing element 120 having one portion 122 exposed to refrigerant line temperatures adjacent the reversing valve 36 and another portion 124 exposed to the ambient outdoor temperature. The second thermostat 118 includes a switch 126 operable by the sensing element 120 when either of the portions 122 or 124 senses a preselected frosting temperature to control operation of the outdoor fan 49. The circuit to the slinger mechanism motor 64 is in parallel with the outdoor fan 49 and in series with the thermostat switch 126. Accordingly, motor 64 is energized only when fan 49 is allowed to operate through switch 126. Since thermostat switch 126 precludes operation of fan 49 during frosting temperature conditions, it also prevents operation of motor 64 during those sensed frosting conditions.

As mentioned hereinabove, the slinger mechanism operates to remove condensate generated only during the heating cycle with the outdoor heat exchanger functioning as the system evaporator. To this end, means are provided to prevent operation of motor 64 when the system is operating in the cooling cycle. The means to prevent operation of the motor 64 during the cooling cycle includes a bimetallic thermostat switch 140 that is arranged in series with the motor 64. The switch 140 is positioned in heat exchange relationship with a portion of the refrigerant system between the outdoor heat exchanger 32 and the reversing valve 36. In the cooling cycle, when the outdoor heat exchanger 32 is functioning as the system condenser, the switch 140 will sense the relatively warm temperature of the refrigerant being discharged from the compressor and open to prevent energization of the slinger mechanism motor 64. This will prevent condensate collecting in the sump from the indoor heat exchanger from being sprayed into the indoor section during the cooling cycle when the indoor heat exchanger is functioning as the system evaporator. During this time of unit operation, the condensate is being disposed of in the outdoor compartment as explained above.

The foregoing is a description of the preferred embodiment of the apparatus of the invention and it should be understood that variations may be made thereto without departing from the true spirit of the invention as defined in the appended claims.

What is claimed is:

1. A self-contained refrigeration heat pump air conditioning unit operable in a heating and cooling cycle for conditioning the air of an enclosure comprising:

a chassis including a base member and a barrier dividing said chassis into an indoor compartment and an outdoor compartment;

indoor and outdoor heat exchangers mounted respectively in said indoor and outdoor compartments;

an indoor air moving means for recirculating enclosure air through said indoor compartment;

an outdoor air moving means for circulating air through said outdoor compartment;

a compressor mounted in said outdoor compartment;

means for selectively connecting said compressor to said heat exchangers whereby said outdoor heat exchanger functions as an evaporator during operation of the unit on the heating cycle and said indoor heat exchanger functions as an evaporator during the cooling cycle;

a condensate collection sump in said outdoor compartment formed in said base member being arranged to collect condensate from said indoor and outdoor heat exchangers;

means for directing condensate formed on said indoor and outdoor heat exchangers into said sump; and condensate disposal means arranged in said outdoor compartment including a housing forming a compartment comprising:

(a) a hood portion projecting from said one wall of said housing to a position overlying a portion of said sump to define a condensate lifting area, (b) a passageway having substantially parallel side walls and upper and lower walls diverging from an inlet communicating with said housing lifting area to an outlet positioned in said indoor compartment through an opening in said barrier, (c) a motor operable in the heating cycle being mounted in said compartment with the drive shaft of said motor extending through one wall of said housing, (d) a condensate lifting disc rotatably mounted on said shaft being positioned under said hood, (e) the diameter of said disc being sufficient to place a portion of its lower circumferentially disposed edge in said sump, said circumferentially disposed edge portion of said disc being tapered to form substantially a knife edge effective for lifting and throwing a diverging thin wall of mist tangentially off said edge portion, (f) said disc being positioned axially on said shaft so that said knife edge is in a plane in alignment with said passageway inlet for directing said diverging thin wall of mist into said passageway inlet and through said passageway outlet in said indoor compartment into the path of air.

2. The self-contained refrigeration heat pump air conditioning unit recited in claim 1 wherein said housing defining said compartment includes impervious side walls and a top wall with said compartment having an open bottom.

3. The self-contained refrigeration heat pump air conditioning unit recited in claim 2 wherein said passageway further includes said lower wall being in a plane tangent with one point on the circumferential edge of said disc and said upper wall being in a plane tangent with a second point on said circumferential edge of said disc to provide upper and lower walls that diverge from said inlet toward said outlet.

4. The self-contained refrigeration heat pump air conditioning unit recited in claim 2 wherein a circumferential collar projecting from said one wall of said housing being concentric with said motor shaft, a hub portion on said disc including a circumferential groove dimensioned to receive said circumferential collar to provide a central hub portion interior of said circumferential collar and a circumferential wall portion of said hub positioned exterior of said circumferential collar to provide a labyrinth between said lifting area and said motor shaft.

5. The self-contained refrigerator heat pump air conditioning unit recited in claim 3 wherein said motor includes mounting means extending therefrom being substantially parallel with said shaft dimensioned to be inserted through openings in said one wall of said housing, guide means on the compartment side of said one wall of said housing being associated with said openings for aligning said mounting means with said openings for guiding said mounting means through said openings.

6. The self-contained refrigeration heat pump air conditioning unit recited in claim 5 wherein said guide means includes grooves aligned with said openings and extending from said open end of said housing to said openings for guiding said mounting means through said openings.

* * * * *